United States Patent [19]

Haneda et al.

[11] Patent Number: 4,478,870

[45] Date of Patent: Oct. 23, 1984

[54] CORONA IMAGE TRANSFER METHOD

[75] Inventors: Satoshi Haneda; Masahiko Itaya, both of Hachioji, Japan

[73] Assignee: Konishiroku Photo Industry Co., Ltd., Tokyo, Japan

[21] Appl. No.: 465,771

[22] Filed: Feb. 11, 1983

[30] Foreign Application Priority Data

Feb. 16, 1982 [JP] Japan ..... 57-21996
Feb. 16, 1982 [JP] Japan ..... 57-21997

[51] Int. Cl.[3] ..... G03G 15/048

[52] U.S. Cl. ..... 427/14.1; 118/648; 355/3 TR

[58] Field of Search ..... 427/14.1; 118/648; 355/3 TR

[56] References Cited

U.S. PATENT DOCUMENTS 3,996,466 12/1976 Davis ..... 355/3 TR
4,055,380 10/1977 Borostyan ..... 355/3 TR
4,353,648 10/1982 Tanaka et al. ..... 355/3 TR

*Primary Examiner*—John H. Newsome
*Attorney, Agent, or Firm*—James E. Nilles

[57] ABSTRACT

A corona discharge method wherein corona ion flow having direct current component with a polarity opposite to an electrification polarity of toner on a transfer material is applied on the transfer material such that a density of the ion flow on incoming half area of corona discharge area is more sparsely than that of the ion flow on outgoing half area, in order to transfer the toner from an image receptor onto the transfer material.

13 Claims, 7 Drawing Figures

PRIOR ART FIG. 1
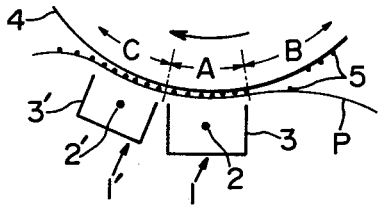
FIG. 2
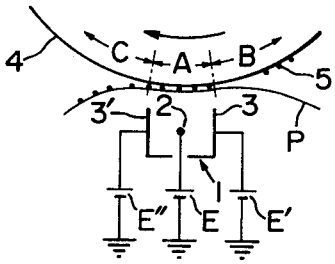
FIG. 3
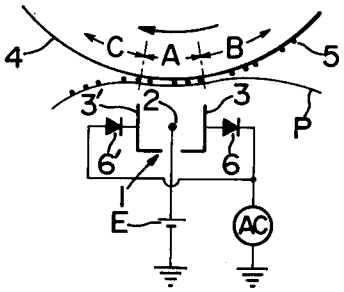

CORONA IMAGE TRANSFER METHOD

BACKGROUND OF THE INVENTION

1. Field of the Invention

The present invention relates to a corona discharge method and more specifically to the improvement in the method of transferring toner images and separating the transfer material loaded with toner particles from the image receptor, especially in the electrophotographic reproducing apparatus which uses a corona discharger.

2. Description of the Prior Art

In one of the methods available for separating the transfer material in the conventional reproducing apparatuses, an adhesive transfer material is placed in contact under pressure with the image receptor to transfer the toner image from the image receptor to the transfer material and then the transfer material is separated from the image receptor by a blade. In other conventional method, a voltage with a polarity opposite to the toner charge on the image receptor is applied by the electrode roller or corona discharger to the back of the transfer material to transfer the toner image from the image receptor to the transfer material and then the transfer material is separated from the image receptor by a means similar to the above or the corona discharger. The latter method employing the corona discharger for the image transfer and separation is widely used because of the advantages that it does not need special transfer material which has adhesiveness; that there is no possibility of the toner image being pressed flat as when the adhesion image transfer or electrode rollers are used; that relatively high transfer efficiency is obtained; that the image receptor is free from being damaged as when the toner image is separated by the separation blade; and that the structure of the device is simple.

In the conventional toner image transfer and transfer material separation method using a corona discharger, as shown in FIG. 1, two separate corona dischargers 1, 1' are used for the image transfer and the transfer material separation respectively. DC and AC corona ion flows are obtained by applying a DC voltage to the discharge wire 2 of the corona discharger 1, applying an AC voltage to the discharger wire 2' of the corona discharger 1' and applying a DC voltage to the cover plates 3, 3' or scorotron grid not shown, or grounding the cover plates 3, 3'.

This method, though advantageous when compared to other methods, has the following drawbacks. As the charge holding performance of the transfer material P decreases due to humidity, the transfer efficiency may also deteriorate. When the DC corona ion flow is intensified to improve the transfer efficiency, the charge of corona ion flow may penetrate through the transfer material P into the toner 5 at the transfer area A, charging the toner 5 to the same polarity with the charge of corona ion flow with the result that the toner 5 is repulsed from the transfer material P resulting in the further reduction in the transfer efficiency or disturbance in the image. The strongly charged transfer material P may attract a part of toner from the image receptor 4 at the pretransfer area B causing image disturbance. Further, since the corona ion flow is symmetrical with respect to the direction in which the transfer material is moving, the reduction in the transfer efficiency and the image disturbance may also result at the separation area C succeeding the transfer area A due to similar reasons cited for the transfer area A and pretransfer area B. To avoid these problems, the discharging conditions of the corona dischargers 1, 1' are necessarily restricted to a very narrow range.

SUMMARY OF THE INVENTION

The primary object of this invention is to eliminate the abovementioned drawbacks of the transfer method using the corona discharger.

Another object of this invention is to provide a method of corona discharging in the electrostatic recording apparatus which overcomes the above drawbacks by pouring over the back of the transfer material the corona ion flow which comprise direct current component distributed on incoming half area and outgoing half area of corona discharging area differently.

Still another object of this invention is to eliminate the above drawbacks experienced with the conventional method that uses a corona discharger in separating the transfer material.

Further object of this invention is to provide a method of transfer material separation by which a high and stable transfer efficiency is obtained without causing image disturbance and by which the transfer material is separated by a single corona discharger.

The transfer material separation method of this invention is characterized in that a corona ion flow having an oscillation component and asymmetrical with respect to the direction of the transfer material feed is applied to the back of the transfer material to transfer the toner particles from the image receptor onto the transfer material and separate the transfer material loaded with the toner particles from the image receptor.

Other objects and features of this invention will become apparent in the following detailed description with reference to the attached drawings.

BRIEF DESCRIPTION OF THE DRAWINGS

FIG. 1 is a schematic diagram of a part of the electrophotographic reproducing apparatus showing the conventional image transfer method;

FIG. 2, 3, 4 and 5 are schematic diagrams of a part of the electrophotographic reproducing apparatus showing the image transfer method of this invention.

DESCRIPTION OF THE PREFERRED EMBODIMENTS

Figure 4:
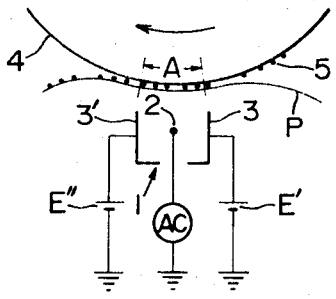

The image transfer method of this invention is explained in the following referring to the embodiments shown in FIGS. 2 through 5.

In the embodiment shown in FIG. 2, the cover plate of the corona discharger 1 is divided into two. The discharge wire 2 is applied with a DC voltage of 4 to 10 kV from a DC power supply E with the polarity opposite to an electrification of toner 5 on the image receptor 4. The cover plate 3 on the incoming side of the transfer material P is applied with a DC voltage of about 1 kV from the DC power supply E' with the same polarity as the voltage for the discharge wire 2 and the cover plate 3' on the outgoing side applied with a DC voltage of approximately 2 kV from the DC power supply E'' with the same polarity. This structure causes the corona ions flowing from the discharge wire 2 against the back of the transfer material P in the transfer area A to be distributed sparsely on the incoming side of the transfer material P and densely on the outgoing side, so that the toner 5 can be prevented from partly shifting onto the transfer material P at the pretransfer area B or from being repulsed from the separation area C, as is the case with the conventional method. Thus, a stable image transfer can be done without image disturbance. This method was applied to the electrophotographic reproducing apparatus U-Bix V of Konishiroku Photo Industry Co., Ltd. in Japan. The result of this test shows that although this embodiment is similar in the transfer efficiency to that of the conventional one shown in FIG. 1, i.e., 70 to 80%, it is excellent in the stability of image clearness or resolution.

The embodiment shown in FIG. 3 differs from that of FIG. 2 in that the cover plate 3 on the incoming side of the transfer material P and the cover plate 3' on the outgoing side are connected to an AC power supply AC with the frequency of 10 to 100 kHz and the voltage of 1 to 2 kV, through rectifying devices 6, 6' whose directions of conduction are opposite to each other. This construction not only deflects the corona ion flow as described in FIG. 2 but also causes it to vary periodically, assuring stable image transfer and improved transfer efficiency without image disturbance. The result of application of this method to the electrophotographic reproducing apparatus U-Bix of Konishiroku Photo Industry Co., Ltd. shows that this method provides stable, clear transfer image and that the transfer efficiency is approximately 75 to 85%, at least 5% higher than the same type of reproducing apparatus using the conventional transfer method shown in FIG. 1. This improvement may be attributed to the following facts: (1) the addition of oscillation element to the corona ion flowing prevents the averaged charged voltage of the transfer material P from becoming excessively high, thereby reducing the amount of ions that would pour into the toner 5 when the corona ion flow becomes momentarily intense; (2) the varying corona ion flow is more effective in transferring the toner 5 than the constant corona ion flow; and (3) since the average charged voltage of the transfer material P is kept from becoming excessively high, not only can the toner 5 in the transfer area A be prevented from being charged to the same polarity but the partial transfer of toner 5 in the pretransfer area B and the repulsion of toner 5 in the separation area C can also be prevented.

FIG. 4 shows a third embodiment which differs from the embodiment of FIG. 2 in that the discharge wire 2 is applied with an AC voltage of 4 to 10 kV with the frequency of 10 to 100 kHz. The corona ion flow is deflected or distributed such that there are greater number of ions of opposite polarity to the electrification polarity of toner 5 on the outgoing side of the transfer material P than on the incoming side. The corona ion flow varies in its intensity periodically. With such corona ion flow poured against the back of the transfer material P in the transfer area A, a stable transfer of image is ensured without image disturbance, which in turn improves the transfer efficiency and makes easy the separation of transfer material P after image transfer. The result of application of this method to the electrophotographic reproducing apparatus U-Bix V shows that the transfer efficiency is approximately 80 to 90%, about 10% higher in average than the conventional method and that clear images have been obtained. This improvement may be explained as having been obtained by the similar but greater effect of the embodiment of FIG. 3. That is, (1) the ion flow contains ions of opposite polarity so that the effect of the ion flow variation is further intensified; and (2) the average voltage applied to the transfer material is further lowered. The DC power supply used in the embodiments of FIGS. 2 and 4 is obtained by applying a rectifying device such as a Zener diode to the AC power supply.

Figure 5:
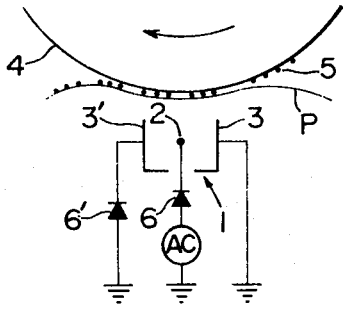

In the embodiment shown in FIG. 5, the discharge wire 2 of the corona discharger 1 is applied with a pulsating voltage from an AC power supply AC through a rectifying device 6. The cover plate 3 on the incoming side of the transfer material P is directly earthed and the cover plate 3' on the outgoing side is earthed via a rectifying device 6'. This construction makes a greater quantity of pulsating corona ions pouring over the back of the transfer material P on the outgoing side than on the incoming side. This method was also applied to the reproducing machine U-Bix V and the results similar to those of FIG. 3 have been obtained.

This invention is not limited to the sine wave of AC power supply and it is also possible to replace the method of producing deflection and pulsation in the corona ion flow with the method using a scorotron grid. That is, the field density produced by the scorotron grid on the incoming and outgoing sides of the transfer material is varied. Or it is possible to provide two scorotron grids each on the incoming and outgoing side and apply varying voltages to them. The voltage applied to the scorotron guide may also be pulsated. It is also possible to use two or more discharge wires in the corona discharger and apply varying voltages to these wires.

As can be seen from the foregoing, this invention assures stable and efficient transfer of clear image with a simple construction.

Figure 6:
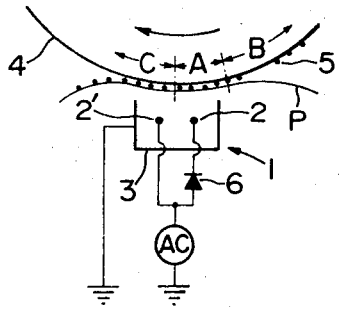
FIGS. 6 and 7 are schematic diagrams of a part of the electrophotographic reproducing apparatus showing the transfer material separation method of this invention.
Figure 7:
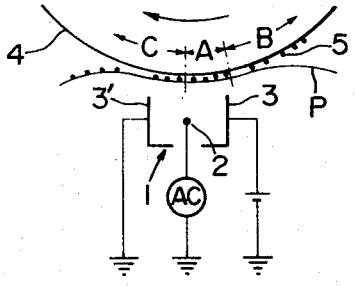

Referring to FIGS. 6 and 7, the transfer material separation method of this invention is explained in the following.

In the embodiment of FIG. 6, the corona discharger 1 is provided with two discharge wires 2, 2'. The discharge wire 2 on the incoming side of the transfer material P is applied with an AC voltage of 4 to 10 kV with the frequency of 10 to 100 kHz through a rectifying device 6. The other discharge wire on the outgoing side is applied with the same AC voltage and the cover plate 3 is grounded. This construction causes the discharge wire 2 to apply the varying corona ion flow of a polarity opposite to the electrification polarity of toner 5 on the image receptor 4 to the back of the transfer material P in the transfer region A or on the incoming side of the transfer material P. The second discharge wire 2' applies the positive-negative charging corona ion flow to the back of the transfer material P on the outgoing side of the transfer material. Since the varying corona ion flow is applied to the transfer material P on the incoming side, the charge of corona ion flow can be prevented from pouring into the toner 5 on the image receptor 4 even when the AC voltage applied to the discharge wire 2 is increased and the toner 5 can also be prevented from partly being attracted and transferred to the transfer material in the pretransfer region B. This assures smooth transfer of toner 5 from the image receptor 4 onto the transfer material P without causing any disturbance in the image. Because the AC voltage applied to the discharge wire 2 can be increased without causing any trouble, a stable, high transfer efficiency can be maintained even when the charge holding capability of the transfer material P decreases. Further the fact that the positive-negative changing corona ion flow is applied to the transfer material P on the outgoing side makes it possible to increase the AC voltage applied on the discharge wire 2' thereby assuring stable, reliable removal of charges from the transfer material P, which in turn permits the transfer material P to be easily separated from the image receptor 4. The result of application of this embodiment of FIG. 6 to the reproducing machine U-Bix V of Konishiroku Photo Industry Co., Ltd. shows that the transfer efficiency is about 75 to 85% and stable and clear images have been obtained. On the other hand, the use of the two separate corona discharger 1, 1' such as shown in FIG. 1 in the same U-Bix V resulted in the transfer efficiency of 70 to 80%, down approximately 5% from the above embodiment.

As to the embodiment shown in FIG. 7, the discharge wire 2 of the corona discharger 1 is directly applied with the same AC voltage as that of FIG. 6. The cover plate is electrically divided in two with the cover plate 3 on the incoming side of the transfer material P being applied with a DC voltage of a polarity opposite to the toner 5 on the image receptor 4 and with the other cover plate 3' on the outgoing side being directly grounded. This construction causes the discharge wire 2 to apply to the transfer material P in the transfer region A on the incoming side the varying corona ion flow abounding ions of a polarity opposite to the toner 5 and apply to the transfer material P in the separation region C on the outgoing side the positive-negative changing ion flow which neutralizes the charge on the transfer material. Therefore, as with the embodiment of FIG. 6, this embodiment shown in FIG. 7 also provides stable, efficient image transfer without disturbance and easy separation of the transfer material from the image receptor. The application of the embodiment to the U-Bix V has resulted in the high transfer efficiency of 80 to 90%, an improvement of about 10% over the conventional method. It is needless to say that instead of applying the DC voltage to the cover plate 3' it is possible to use a rectifying device such as a Zener diode in the DC power supply.

The reasons attributable to the excellent separation of the transfer material achieved by this invention are listed in the following. (1) Since the corona ion flow is varied, the transfer material is prevented from being charged excessively and therefore the voltage applied becomes stable making it possible to control the corona ion flow in a wider range. (2) The force by which the toner is transferred from the image receptor onto the transfer material is more effectively obtained by the varying ion flow than by the constant DC ion flow. (3) As mentioned in (1), the average voltage applied by the varying ion flow to the transfer material is low, so that the toner in the transfer region can be prevented from charged to the opposite polarity or a part of the toner in the pretransfer region prevented from being transferred. (4) Since the separation region is close to the transfer region and the voltage of the transfer material varies continuously in a narrow range, the toner can be prevented from being charged to opposite polarity thus eliminating the image disturbance and the transfer efficiency reduction.

As described above, the present invention can be applied to various forms of embodiment with many modifications. That is, the corona discharger 1 may be provided with two discharge wires; or instead of directly connecting the cover plate 3 on the incoming side of the transfer material P to the DC power supply, it may be grounded through a rectifying device to obtain the same charging as obtained by connecting the cover plate 3 directly to the DC power supply. Or the corona ion flow may be varied by the scorotron grid. It is needless to say that the number of discharge wires are not limited to two and the toner particles are preferably insulating material.

What is claimed is:

1. A corona discharge method comprising step of supplying corona ion flow having a direct current component with a polarity opposite to an electrification polarity of toner on a transfer material, wherein a density of the ion flow of an incoming area of a corona discharge area is less than that of the ion flow on an outgoing area.

2. The method as set forth in claim 1, wherein the direct current component of the corona ion flow is distributed more sparsely on the incoming area than on the outgoing area.

3. The method as set forth in claim 2, wherein the corona ion flow comprises an oscillating current component.

4. The method as set forth in claim 1, wherein the direct current component of the corona ion flow is distributed only on the incoming area and the ion flow comprises an oscillating current component.

5. A method for operating a corona discharge device which is located adjacent a corona discharge area having an incoming region and an outgoing region through which passes transfer material with electrically charged toner thereon, said corona discharge device including an electrode at least partially surrounded by a shield, said method comprising the steps of: providing a shield comprising at least two conductive shield segments which are electrically insulated from each other, one shield segment being opposite said incoming region and the other shield segment being opposite said outgoing region, maintaining a voltage of a predetermined value at said electrode, maintaining a voltage at said one shield segment which has a value less than said predetermined value, maintaining a voltage at said other shield segment which has a value greater than that of said one shield segment, said voltages operating to supply a corona ion flow on the back of said transfer material which has a direct current component with a polarity opposite to the polarity of said electrically charged toner on said transfer material and whereby the density of said corona ion flow at said incoming region is less than that at said outgoing region; and effecting oscillation of at least one of said voltages to effect oscillation of said corona ion flow.

6. A method according to claim 5 wherein the step of maintaining a voltage at said electrode consists of applying alternating current voltage to said electrode whereby the step of effecting oscillaction is accomplished.

7. A method according to claim 6 wherein the step of maintaining voltage at said shield segments consists of applying direct current voltage to said shield segments.

8. A method according to claim 5 wherein the step of maintaining voltage at said shield segments consists of applying alternating current voltage to said shield segments whereby the step of effecting oscillation is accomplished.

9. A method according to claim 8 wherein the step of maintaining voltage at said electrode consists of applying direct current voltage to said electrode.

10. A method for operating a corona discharge device which is located adjacent a corona discharge area having an incoming region and an outgoing region through which passes transfer material with electrically charged toner thereon, said corona discharge device including electrode means at least partially surrounded by a conductive shield, said method comprising the steps of: providing a shield comprising one shield segment opposite said incoming region and another shield segment opposite said outgoing region, maintaining an oscillating voltage of a predetermined value at said electrode means, maintaining a voltage at said one shield segment which has a value less than said predetermined value, maintaining a voltage at said other shield segment which has a value less than that of said one shield segment, said voltages operating to supply a corona ion flow on the back of said transfer material which has a direct current component with a polarity opposite to the polarity of said electrically charged toner on said transfer material and whereby said corona ion flow exists at said incoming region.

11. A method according to claim 10 wherein the step of maintaining a voltage at said other shield segment which has a value less than that of said one shield segment consists of the step of grounding said other shield segment.

12. A method according to claim 11 wherein the step of maintaining an oscillating voltage at said electrode means consists of the step of supplying a.c. voltage thereto.

13. A method for operating a corona discharge device which is located adjacent a corona discharge area having a incoming region and an outgoing region through which passes transfer material with electrically charged toner thereon, said corona discharge device including electrode means at least partially surrounded by a shield, said method comprising the steps of: providing a shield comprising at least two conductive shield segments which are electrically insulted from each other, one shield segment being opposite said incoming region and the other shield segment being opposite said outgoing region, maintaining an oscillating voltage of a predetermined value at said electrode means, maintaining a voltage at said one shield segment which has a value less than said predetermined value, maintaining a voltage at said other shield segment which has a value less than that of said one shield segment, said voltages operating to supply a corona ion flow on the back of said transfer material which has a direct current component with a polarity opposite to the polarity of said electrically charged toner on said transfer material and whereby said corona ion flow exists at said incoming region.

* * * * *